US010633837B2

(12) United States Patent
Chen

(10) Patent No.: US 10,633,837 B2
(45) Date of Patent: Apr. 28, 2020

(54) STRUCTURAL IMPROVEMENT OF PISTON SET FOR USE IN HYDRANT

(71) Applicant: CHUAN WEI METAL CO., LTD., Changhua County (TW)

(72) Inventor: Chi-Chuan Chen, Changhua County (TW)

(73) Assignee: CHUAN WEI METAL CO., LTD., Changhua County (TW)

( * ) Notice: Subject to any disclaimer, the term of this patent is extended or adjusted under 35 U.S.C. 154(b) by 112 days.

(21) Appl. No.: 15/787,165

(22) Filed: Oct. 18, 2017

(65) Prior Publication Data

US 2019/0112793 A1 Apr. 18, 2019

(51) Int. Cl.

| | |
|---|---|
| ***E03B 9/04*** | (2006.01) |
| ***E03B 9/14*** | (2006.01) |
| *E03B 9/02* | (2006.01) |

(52) U.S. Cl.

CPC ..... *E03B 9/04* (2013.01); *E03B 9/14* (2013.01); *E03B 2009/022* (2013.01); *Y10T 137/538* (2015.04)

(58) Field of Classification Search

CPC ..... E03B 2009/022; E03B 9/04; E03B 9/14; Y10T 137/538

See application file for complete search history.

(56) References Cited

U.S. PATENT DOCUMENTS

| | | | | | |
|---|---|---|---|---|---|
| 200,162 | A * | 2/1878 | Bains | E03B 9/14 | 137/281 |
| 287,815 | A * | 11/1883 | Fletter | E03B 9/04 | 137/291 |
| 786,671 | A * | 4/1905 | Parker | E03B 9/04 | 137/291 |
| 2,099,928 | A * | 11/1937 | Doppelhammer | E03B 9/14 | 137/285 |
| 3,103,231 | A * | 9/1963 | Moen | E03C 1/023 | 137/454.2 |
| 3,672,392 | A * | 6/1972 | Anderson | E03B 9/20 | 137/288 |
| 3,840,048 | A * | 10/1974 | Moen | F16K 11/085 | 137/454.6 |
| 3,926,207 | A * | 12/1975 | Anderson | E03B 9/04 | 137/281 |
| 3,939,861 | A * | 2/1976 | Thompson | E03B 9/04 | 137/299 |

(Continued)

*Primary Examiner* — Matthew W Jellett
*Assistant Examiner* — Christopher D Ballman
(74) *Attorney, Agent, or Firm* — Chun-Ming Shih

(57) ABSTRACT

An improved hydrant structure with an integral piston set is provided with the hydrant main body having a valve chamber for receiving a water control valve. The water control valve is composed of a valve member, rubber pads, a piston cylinder with an integrally enclosed structure and a piston rod disposed inside the valve member, a valve rod, a cover, a valve cap, and a rotary button; the outer side of the piston cylinder is formed with different outer diameters, and the preset portions thereof are formed with a water inlet and a water outlet holes, such that the piston rod can be adjusted to alter the relative relation, thereby achieving functions of starting/terminating water supply and adjusting water mixing ratio. The piston cylinder with an integrally enclosed structure is formed through a stainless steel base pipe and a plastic sleeve member enclosing the exterior thereof.

3 Claims, 5 Drawing Sheets

(56) References Cited

U.S. PATENT DOCUMENTS

| | | | | |
|---|---|---|---|---|
| 4,305,419 | A * | 12/1981 | Moen | F16K 3/08 137/243 |
| 4,478,388 | A * | 10/1984 | George | F16K 5/0271 251/309 |
| 7,059,337 | B2 * | 6/2006 | Ball, Jr. | E03B 9/14 137/1 |
| 7,165,570 | B1 * | 1/2007 | Lordahl | F16K 11/078 137/454.6 |
| 9,016,317 | B2 * | 4/2015 | Myrhum, Jr. | F16K 15/18 137/522 |
| 9,194,108 | B2 * | 11/2015 | Fleury, Jr. | E03B 9/02 |
| 9,890,867 | B2 * | 2/2018 | Ball | F16K 27/006 |
| 2007/0108056 | A1 * | 5/2007 | Nyberg | B01D 61/44 204/554 |
| 2012/0312396 | A1 * | 12/2012 | Hoppe | F01L 1/344 137/511 |
| 2014/0158602 | A1 * | 6/2014 | Loniewski | C02F 1/003 210/236 |
| 2016/0341319 | A1 * | 11/2016 | Palle | F16K 31/383 |

* cited by examiner

STRUCTURAL IMPROVEMENT OF PISTON SET FOR USE IN HYDRANT

BACKGROUND OF THE INVENTION

Field of the Invention

The present invention relates to a structural improvement of piston set for use in hydrant, especially relates to a novel structural design for a piston cylinder of a piston set disposed inside a water control valve of a hydrant for enabling the piston cylinder to be formed with a composite structure, so that under the principle of not affecting the whole functions, the processing procedure can be effectively simplified, the whole cost can be greatly reduced, and a better industrial application value is provided.

Description of Related Art

A hydrant is often adopted in a conventional water dispensing equipment for supplying or terminating water supply, the hydrant is respectively connected to a cold and a hot water pipes, and a water control valve disposed inside the hydrant is served to regulate and adjust the water supplying ratio of the cold and the hot water, so that an objective of adjusting the temperature of the outputted water can be achieved, and the water temperature can be adjusted with respect to different operating requirements or water consuming habits.

The structural design of the water control valve of the above-mentioned hydrant is mainly provided with a hydrant main body capable of being connected to an external water supplying pipeline, a slot chamber is formed in the hydrant main body for allowing a water control valve to be received, the water control valve includes a valve member, the interior of the valve member is formed with an accommodation chamber for allowing a piston set composed of a piston cylinder and a piston valve member to be accommodated therein, and two sides of the valve member are respectively formed with a water inlet hole, and rubber pads are provided for establishing a watertight relation with the water inlet pipe of the hydrant main body and the piston set; the piston cylinder of the piston set is formed in a status of having different diameters, and preset locations thereof are formed with a water inlet and a water outlet holes, so that a valve rod disposed at the top end of the valve member is able to operate a piston rod for altering the relative relation with the piston cylinder so as to achieved the desired water inlet ratio of the cold and the hot water, thereby being provided with a function of adjusting the water temperature.

However, in the fabrication of the piston cylinder of the water control valve of the above-mentioned hydrant, a stainless steel bar is adopted for being processed with a turning treatment for the purpose of formation, the various outer diameters have to be additionally formed, and an inner radial hole of the piston rod set is also required to be additionally formed, meanwhile preset locations defined at the exterior are processed for being formed with a water inlet and a water outlet holes, thus the whole processing operation is complicated and time consuming, moreover, the material loss caused by the turning treatment is relatively large, so the material cost is inevitably increased, and the whole production cost is therefore affected, the above-mentioned disadvantages are unable to provide any economic benefit in industrial use; furthermore, an excellent sealing relation is hard to be established between the metal surface of the piston set and the rubber pad, and a problem of water leaking may happen, thus the skilled people in the art shall improve the shortages and the disadvantages existed in the prior art.

SUMMARY OF THE INVENTION

In view of the piston cylinder of the piston set of the conventional hydrant is fabricated through the stainless steel bar being processed with a turning treatment, the whole production cost is high and the industrial application value is therefore affected, the applicant of the present invention has devoted himself for designing an improved structure of piston cylinder.

For solving the problem of increased cost caused by the conventional piston cylinder being formed through the stainless steel bar being processing with an integral turning treatment for the purpose of formation, the applicant of the present invention provides a design in which, under the principle of not affecting the function of the piston cylinder, a stainless steel pipe is adopted and formed with a water inlet and a water outlet holes, then is disposed in a mold for allowing a plastic sleeve member to be injected for the purpose of enclosing, so that the piston cylinder having composite materials is formed; accordingly, the processing procedure is simplified, the cost of the stainless steel is saved while the structural strength being remained.

According to the structural improvement of piston set provided by the present invention, a novel design of the piston cylinder being formed through a stainless steel pipe being enclosed by injecting the plastic sleeve member is adopted, so under the principle of not affecting the whole assembling relation and the functions to be achieved, the processing procedure can be effectively simplified, the material cost can be saved, the watertight relation between the piston set and rubber pads can be effectively improved, thus the present invention is provided with better economic benefits and more practical in industrial use, and disadvantages existed in the prior art can be solved.

DETAILED DESCRIPTION OF THE PREFERRED EMBODIMENT

One preferred embodiment of the present invention will be described with reference to the drawings for illustrating the structural assembly, the technical means and the functions to be achieved by the present invention.

Figure 1:
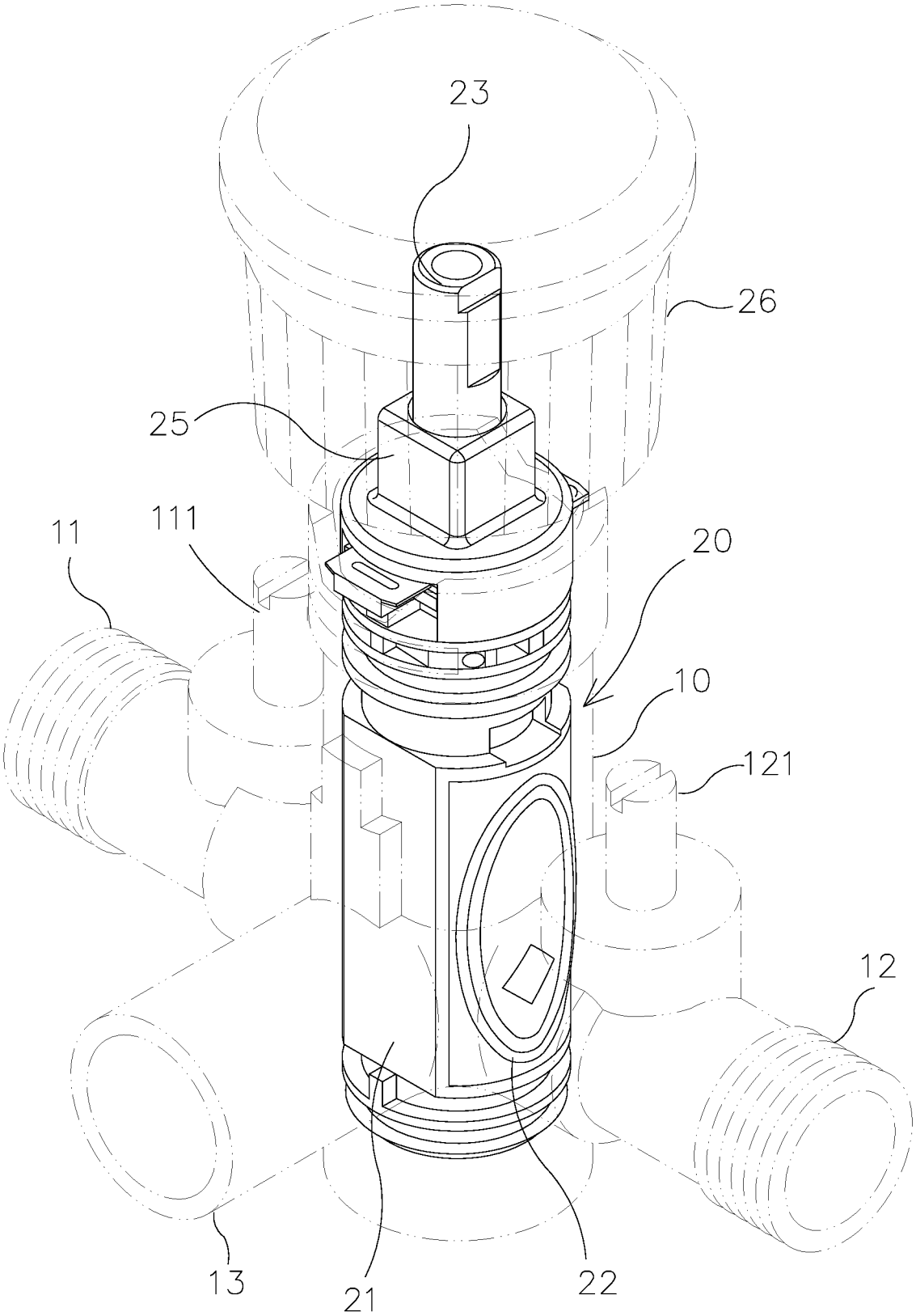
FIG. 1 is a schematic view showing the structure according to one preferred embodiment of the present invention.
Figure 2:
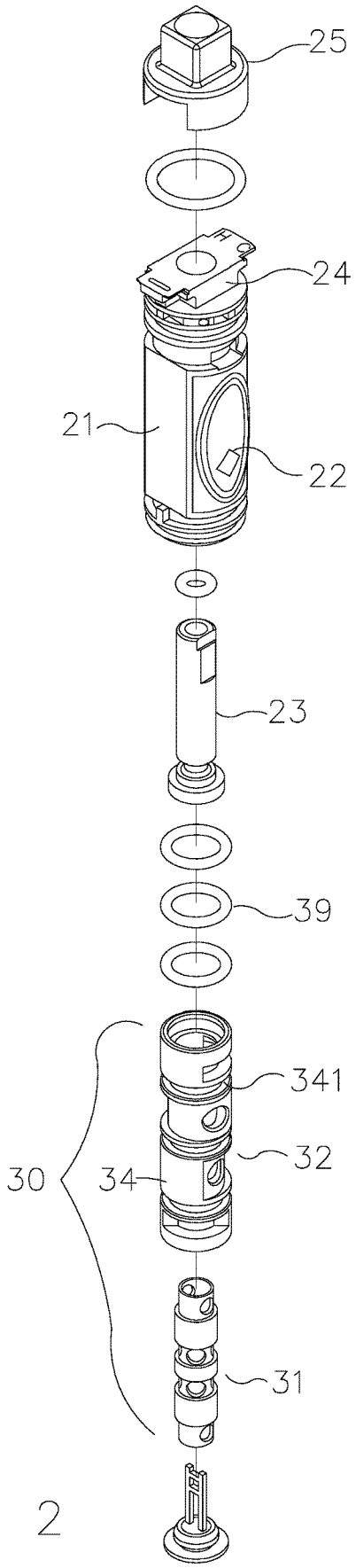
FIG. 2 is an exploded view showing the structure of the water control valve according to one preferred embodiment of the present invention.
Figure 3:
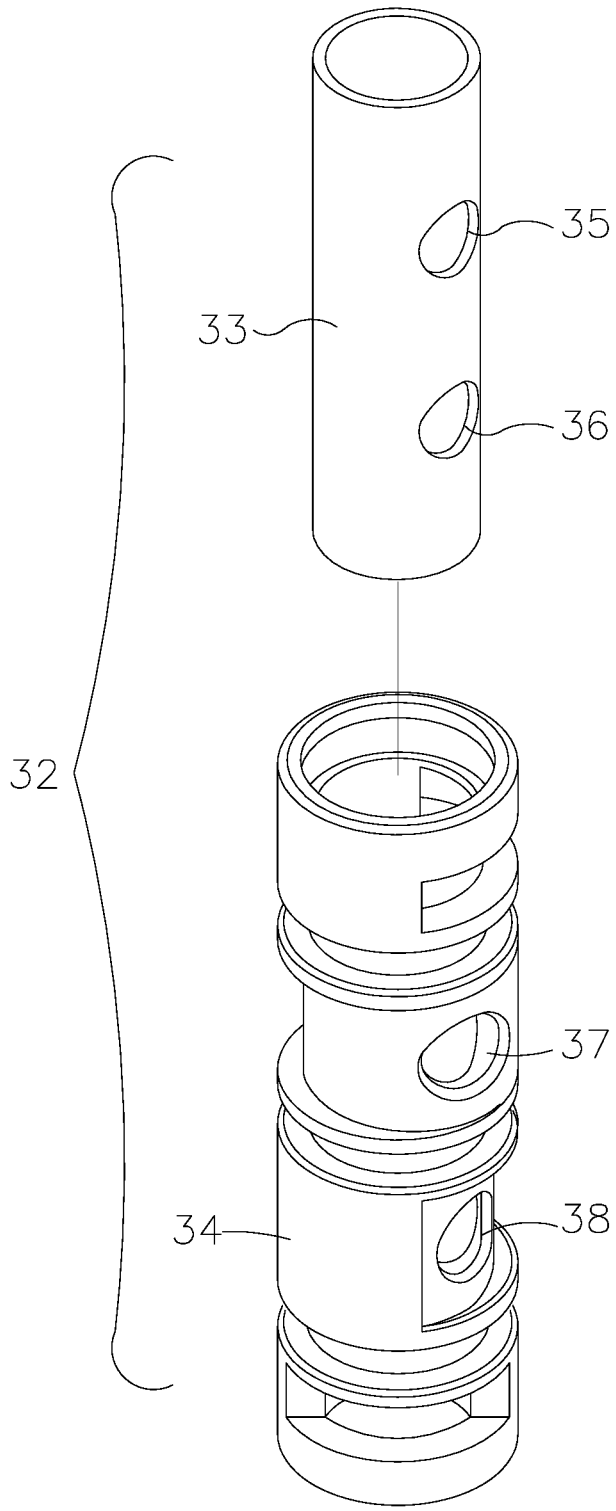
FIG. 3 is a schematic view showing the structure of the piston cylinder according to one preferred embodiment of the present invention.
Figure 4:
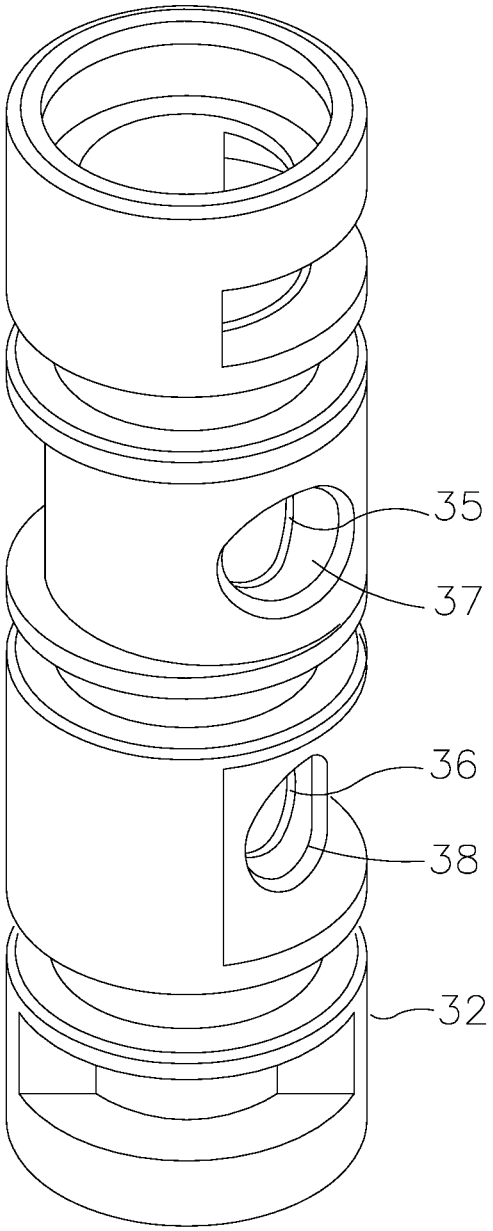
FIG. 4 is an exploded view showing the structure of the piston cylinder according to one preferred embodiment of the present invention.
Figure 5:
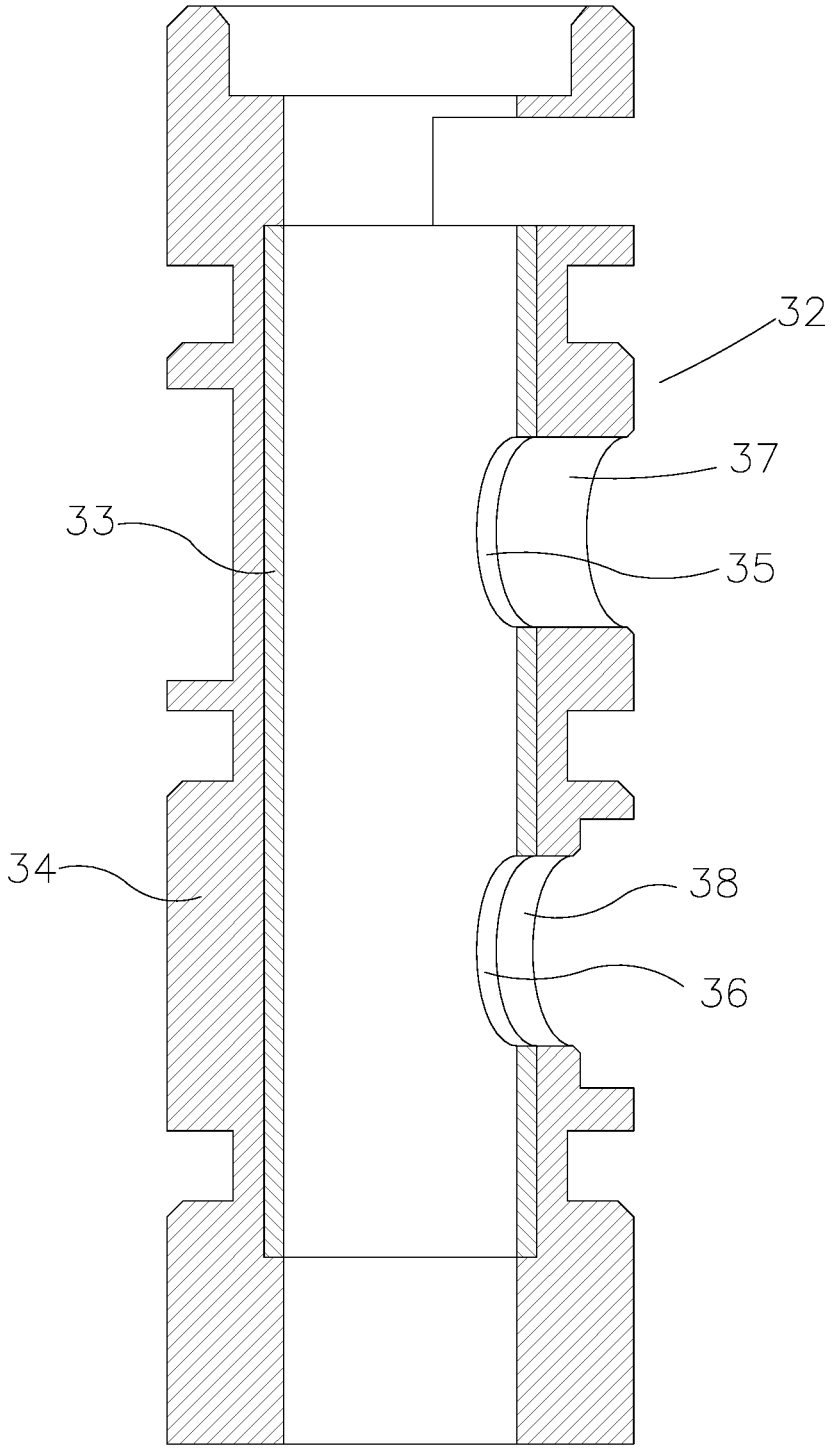
FIG. 5 is a schematic view showing the structural relation of the piston cylinder according to one preferred embodiment of the present invention.

Referring from FIG. 1 to FIG. 5, according to one preferred embodiment of the present invention, a hydrant provided by the present invention mainly includes a hydrant main body (10), two sides of the hydrant main body (10) are respectively formed with a water inlet pipe end (11, 12) for being connected to a water supplying pipeline (not shown in figures), the front end thereof is extended with a water outlet pipe end (13) for being connected to a water dispensing pipeline (not shown in figures), preset locations defined at the two water inlet pipe ends (11, 12) are respectively disposed with a water control bolt (111, 121) for adjusting the water inlet amount, the center of the hydrant main body (10) is upwardly extended with a valve chamber (not shown in figures) for receiving a water control valve (20), the water control valve (20) is composed of a valve member (21), rubber pads (22) at two sides of the valve member (21), a piston set (30) disposed inside the valve member (21), a valve rod (23) for operating the piston set (30), a cover (24), a valve cap (25), and a rotary button (26) for locking and operating the valve rod (23), wherein the piston set (30) is composed of a piston rod (31) and a piston cylinder (32), the outer side of the piston cylinder (32) is designed to be formed with different outer diameters and formed through a stainless steel base pipe (33) and a plastic sleeve member (34) covering the exterior thereof, the stainless steel base pipe (33) is formed through directly cutting a stainless steel pipe, and preset portions thereof are formed with a water inlet and a water outlet holes (35, 36), then the stainless steel base pipe (33) is disposed in a preset mold (not show in figures), a plastic material is adopted for being injected so as to enclose the stainless steel base pipe (33), with a cavity design inside the mold, the plastic sleeve member (34) having a preformed status with various diameters is formed, and the plastic sleeve member (34) is respectively formed with a hole slot (37, 38) corresponding to the water inlet and the water outlet holes (35, 36) of the stainless steel base pipe (33), so that the stainless steel base pipe (33) can be integrally enclosed in the interior of the plastic sleeve member (34) for forming the piston cylinder (32) having composite materials; accordingly, under the principle of not affecting the structural status and the functions to be achieved, the original structural strength can be remained, meanwhile an excellent sealing effect can be formed between the rubber pads (22) at the two sides of the valve member (21) and the piston cylinder (32), and the outer circumference of the plastic sleeve member (34) of the piston cylinder (32) is formed with a plurality of annular slots (341) for allowing O-rings (39) to be mounted, so when the piston cylinder (32) is disposed inside the valve member (21), a watertight relation can be established, and the water inlet and the water outlet holes thereof and the water inlet and the water outlet holes of the valve member (21) are spaced from each other for forming independent water passageways, so that the valve rod (23) can be operated for regulating and controlling the piston rod (31) disposed in the interior so as to alter the relative relation with the piston cylinder (32), thereby achieving functions of starting/terminating water supply and adjusting the water mixing ratio.

Accordingly, without altering the whole assembling components and the functional frame of the hydrant, the present invention enables the piston cylinder of the piston set to be formed through the stainless steel base pipe being enclosed by injecting the plastic sleeve member so as to be provided with a structural design with composite materials, and without affecting the whole assembling relation and the functions to be achieved, the processing procedure of the piston cylinder can be simplified, so that the cost of the stainless steel can be saved while the structural strength being remained, and because the exterior of the piston cylinder is provided with the plastic material, an excellent sealing effect can be formed with the rubber pads at the two sides of the valve member; as such, the present invention is provided with better economic benefits and more practical in industrial use, and disadvantages existed in the conventional structure of the piston cylinder being formed through directly turning a stainless steel bar can be solved.

Based on what has been disclosed above, with the structural improvement of piston set for use in hydrant provided by the present invention, under the principle of not altering the conventional structural assembly of the hydrant and the functions to be achieved, the piston cylinder of the piston set is formed through the stainless steel base pipe being enclosed by the plastic sleeve member so as to form a structure having composite materials, thus the processing procedure of the piston cylinder can be simplified and the cost of the stainless steel can be saved, the original structural strength can be remained and the watertight effect can be enhanced; accordingly, the structural improvement of piston set for use in hydrant provided by the present invention is more suitable to be applied in the industrial use and has a better application value. Moreover, the structural improvement of piston set for use in hydrant provided by the present invention is able to solve the disadvantages and shortages existed in the prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An improved hydrant with comprising:

a hydrant main body, wherein two sides of which are respectively formed with a water inlet pipe end for being connected to a water supplying pipeline, with preset locations defined at two water inlet pipe ends being respectively disposed with a water control bolt for adjusting water inlet amount; a front end of which is extended with a water outlet pipe end for being connected to a water dispensing pipeline; and a center of which is upwardly extended with a valve chamber for receiving a water control valve, which is composed of:

a valve member, rubber pads at two sides of the valve member, inside which an integral piston set is disposed, a valve rod for operating the piston set, a cover, a valve cap, and a rotary button for locking and operating the valve rod, wherein the integral piston set is a composite of a piston rod and a composite piston cylinder with an integrally enclosed structure made up of a stainless steel base pipe and a plastic sleeve member covering an exterior of the stainless steel base pipe.

2. A method of manufacturing the hydrant structure according to claim 1, wherein the stainless steel base pipe with holes thereon is formed through directly cutting a stainless steel pipe, and preset portions thereof are formed with a water inlet and a water outlet holes; and after the stainless steel base pipe has been disposed in a preset mold, the plastic sleeve member is formed through plastic being injected into the mold having preset cavities, thereby enabling the plastic sleeve member to integrally enclosed at the exterior of the stainless steel base pipe, and the plastic sleeve member being respectively formed with corresponding holes thereon aligned to the water inlet and the water outlet holes of the stainless steel base pipe.

3. The method of manufacturing the hydrant structure according to claim 2, wherein an outer side of the composite piston cylinder is formed with different outer diameters, and preset portions thereof are formed with a water inlet and a water outlet holes, so that the valve rod is able to be operated for regulating and controlling the piston rod disposed in an interior of the piston cylinder so as to alter a relative relation, thereby achieving functions of starting and/or terminating water supply and adjusting a water mixing ratio.

* * * * *